US006423407B1

(12) United States Patent
Abe et al.

(10) Patent No.: US 6,423,407 B1
(45) Date of Patent: Jul. 23, 2002

(54) POLYTRIMETHYLENE TEREPHTHALATE FIBER

(75) Inventors: Takao Abe; Jinichiro Kato; Teruhiko Matsuo, all of Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/807,543

(22) PCT Filed: Oct. 15, 1999

(86) PCT No.: PCT/JP99/05713

§ 371 (c)(1),
(2), (4) Date: Apr. 13, 2001

(87) PCT Pub. No.: WO00/22210

PCT Pub. Date: Apr. 20, 2000

(30) Foreign Application Priority Data

Oct. 15, 1998 (JP) ..... 10-293477

(51) Int. Cl.[7] ..... D01F 6/00; B22D 28/00; B27B 17/00

(52) U.S. Cl. ..... 428/364; 428/395; 264/103; 264/130; 264/210.3; 264/211.14

(58) Field of Search ..... 428/364, 395; 264/103, 130, 210.3, 211.14

(56) References Cited

U.S. PATENT DOCUMENTS

| | | | | |
|---|---|---|---|---|
| 5,108,675 A | * | 4/1992 | Matsuo et al. | 264/103 |
| 6,242,091 B1 | * | 6/2001 | Howell et al. | 428/395 |
| 6,284,370 B1 | * | 9/2001 | Fujimoto et al. | 428/395 |
| 6,316,101 B2 | * | 11/2001 | Kato et al. | 428/364 |

FOREIGN PATENT DOCUMENTS

| | | |
|---|---|---|
| JP | 52-5320 | 1/1977 |
| JP | 52-8123 | 1/1977 |

(List continued on next page.)

OTHER PUBLICATIONS

The Mechanical Properties and Structure of Poly(m–methylene Terephthalate) Fibers, I.M. Ward et al., Jour. of Polymer Science; Polymer Physics Edition, vol. 14, 263–274 (1976).

"Mechanical properties of fibers made of polytrimethylene terephthalate," H. L. Traub, et al., Chemical Fibers International, vol. 45, Apr. (1995) 110–111.

*Primary Examiner*—N. Edwards
(74) *Attorney, Agent, or Firm*—Finnegan, Henderson, Farabow, Garrett & Dunner, L.L.P.

(57) ABSTRACT

A polytrimethylene terephthalate fiber composed of a polytrimethylene terephthalate (PTT) comprising not less than 95 mole % of a polytrimethylene terephthalate repeating unit and having an intrinsic viscosity of from 0.7 to 1.3, wherein the fiber satisfies the following features:

(1) a degree of crystalline orientation of from 88% to 95%, (2) a peak value of dynamic loss tangent (tan δ) max of from 0.10 to 0.15, (3) a peak temperature Tmax (°C.) of dynamic loss tangent 102 to 116° C., (4) an elongation at break of from 36 to 50%, (5) a peak value of thermal stress being between 0.25 and 0.38 g/d, (6) a fiber to fiber dynamic frictional coefficient of from 0.30 to 0.50; and the PTT fiber having an excellent processability can be obtained through a drawing process in which the undrawn yarn can be stably drawn.

The PTT fiber can be produced by melt-spinning PTT having an intrinsic viscosity of 0.7–1.3 at a withdrawal speed of 2,000 m/min or less to obtain a undrawn yarn, and then drawing and heat-treating the undrawn yarn by means of draw-twister.

10 Claims, 4 Drawing Sheets

FOREIGN PATENT DOCUMENTS

| | | |
|---|---|---|
| JP | 52-8124 | 1/1977 |
| JP | 58-104216 | 6/1983 |
| JP | 63-059412 | 3/1988 |
| JP | 11-229276 | 8/1999 |
| WO | WO 96/00808 | 1/1996 |
| WO | 99-27168 | 6/1999 |
| WO | WO 99/39041 | 8/1999 |

* cited by examiner

POLYTRIMETHYLENE TEREPHTHALATE FIBER

TECHNICAL FIELD

The present invention relates to a polytrimethylene terephthalate fiber, as a kind of polyester and, more particularly, to a polytrimethylene terephthalate fiber which is capable of being processed into a wide variety of processed yarns and knitted and woven fabrics and is also suited for use in the field of clothing where characteristic knitted and woven fabrics should be provided.

BACKGROUND ART

Polyester fibers composed mainly of polyethylene terephthalate are mass-produced, around the world, as fibers which are most suited for clothing, and the polyester fiber industry is an industry of great importance at present.

On the other hand, polytrimethylene terephthalate fibers (hereinafter referred to as "PTT fibers") have been studied for a long time, but have never been produced industrially. However, a method of producing trimethylene glycol as a glycol component at a low price has recently been discovered and the possibility for industrialization of PTT fibers have been enhanced.

Great hopes are entertained of PTT fibers, which are epochal fibers with merits of both polyester fibers and nylon fibers, and application of PTT fibers to clothing, carpets and nonwoven fabrics has already begun by making use of features thereof.

PTT fibers have been known for a long time and prior arts have been disclosed in Unexamined Patent Publication (Kokai) No. 52-5320 (A), Unexamined Patent Publication (Kokai) No. 52-8123 (B), Unexamined Patent Publication (Kokai) No. 52-8124 (C), Unexamined Patent Publication (Kokai) No. 58-104216 (D), J. Polymer Science: Polymer Physics Edition, Vol. 1, 14, 263–274 (1976) (E), and Chemical Fibers International Vol. 45, April (1995), 110–111 (F).

As is apparent from these prior arts, the features of PTT fibers are physical properties similar to those of nylon fibers, for example, smaller initial modulus than that of polyethylene terephthalate fibers (described in D, E, and F), excellent elastic recovery (described in A, D, and E), large thermal shrinkage (described in B), and good dyeability (described in D). It can be said that the main features of PTT fibers lie in soft feeling, stretching properties and low-temperature dyeability. Taking these features into consideration, PTT fibers are particularly suited for use in the fields of underclothes (e.g. foundation garments, panty stockings, etc.) where PTT fibers are used in combination with spandex fibers, with regard for clothing.

Specific physical properties of PTT fibers are good elastic properties (stretching properties) and the features thereof lie in that the initial modulus is almost fixed even if the orientation and elongation at break of fibers are changed, and that the elastic recovery is high (described in F). This reason is considered that the elastic modulus of fibers depends on that of the crystal.

As described above, these prior arts describe excellent properties or general features of PTT fibers in detail, but these prior arts neither describe nor suggest an optimum range of physical properties for clothing. That is, these prior arts neither describe nor suggest an optimum design of raw yarn physical properties of PTT fibers for clothing or ideal physical properties of PTT fibers in due consideration of balance.

These prior arts neither describe nor suggest that PTT fibers have specific surface properties, that is, the frictional coefficient is generally very high because of the polymer, which can cause yarn breakage and fluff during the production and processing of PTT fibers.

As the method of producing PTT fibers, known publications described above disclose a two-stage process wherein melt-spun fibers are once taken up as a undrawn yarn and then the undrawn yarn is drawn. Unlike PET, PTT has a glass transition point at the temperature close to room temperature, e.g. 30–50° C., and crystallization proceeds considerably quickly as compared with PET. When shrinkage of fibers in the undrawn yarn is caused by formation of crystallite and relaxation of orientation of molecules, draw spot, fluff and yarn breakage occur during the drawing, thus making it difficult to produce PTT fibers suited for clothing application in an industrially stable manner. As the method of solving the problems of such a two-stage process, for example, WO-96/00808, Published Japanese Translation No. 9-3724 of the PCT Application and WO-99/27168 suggest a method of continuously performing spinning and drawing in one stage without taking up the undrawn yarn. Fibers produced by continuously performing spinning and drawing are taken up into a cheese-shaped package.

This method of continuously performing spinning and drawing is industrially advantageous because of low cost, but the present inventors' study makes it clear that the method has a problem that fibers obtained by the one-stage process causes shrinkage in dimension after taking out fibers from the cheese-shaped package. It has become apparent that, since the stress in fibers taken up into the package is released, fibers are freely shrunken (hereinafter this proportion is referred to as a free shrinkage factor) and fibers are shrunken in length by about 3% or more. When fibers have such a large free shrinkage factor, it becomes necessary to knit or weave an additional length corresponding to the proportion of the free shrinkage factor in the production of a knitted or woven fabric with a predetermined finish size, that is, the textile design becomes complicated. The reason why fibers obtained by continuously performing spinning and drawing show such a high free shrinkage factor is not clear, but is presumed as follows: $\hat{2}$ since fibers are taken up into the cheese-shaped package without releasing the stress applied to-molecules from the molten state to solidification during the formation of fibers, the stress is present in fibers and $\hat{2}$ the stress is present in fibers because of poor thermal fixation of fibers after drawing.

A stress-strain curve of fibers obtained in case spinning and drawing were performed by the two-stage process and that in case where spinning drawing were performed by the one-stage process are shown in FIG. 1 described below. The curve A in FIG. 1 is a curve obtained in case spinning drawing were performed by the two-stage process, and the curve B is a curve obtained in case spinning and drawing were performed by the one-stage process. One inflection point (indicated by the arrow c) exists in case of the two-stage process, whereas, three inflection points exist in case of the one-stage process.

Accordingly, fibers obtained by the two-stage process are suited-for use as fibers for clothing in view of practical use, though the one-stage process is advantageous in view of the production cost.

For the reasons described above, it is strongly required to develop PTT fibers which are obtained by performing spinning and drawing using the two-stage process in due consideration of an optimum design of raw yarn physical properties for clothing or all balance.

WO-99/39041 discloses a method of improving specific surface properties of PTT fibers. This known method improves the surface properties (frictional coefficient) by coating fibers with a surface finishing agent with a specific composition, and discloses that spinning and drawing can be performed by any of the two-stage and one-stage methods described above, a method of producing a semi-drawn yarn without drawing, and a method of producing a drawn yarn. That is, the publication neither describes nor suggests a difference in free shrinkage properties between PTT fibers obtained by the two-stage and one-stage methods as well as practical problems caused by this difference. Moreover, the publication discloses the method which has an object of improving the surface properties of general PTT fibers having a birefringence of 0.025 or more and is directed to PTT fibers having a wide elongation at break within a range from 25 to 180%, and not only does the publication not describe an optimum-range of physical properties of PTT fibers for clothing, but also it neither describes nor suggests the necessity thereof.

DISCLOSURE OF THE INVENTION

As described above, low elongation at break and high frictional properties of a conventional PTT fiber can cause frequent occurrence of yarn breakage and fluff, thus drastically preventing stable production of fibers, and processing such as false twisting of fibers, production and heat-treatment of knitted fabrics or the like.

A first object of the present invention is to provide a PTT fiber which is less likely to cause yarn breakage and fluff in industrial production and also has physical properties and surface properties sufficient to secure smooth false twisting and knitting/weaving. A second object of the present invention is to provide a method of stably producing the fiber as the first object by performing spinning and drawing using the two-stage process. A further specific object of the present invention is to provide a PTT fiber which satisfies a raw yarn quality level capable of sufficiently withstanding warp knitting, weaving and false twisting to which a high quality level is required. The specific object of the present invention is to design proper physical properties and surface properties in view of production of raw yarn, processing of raw yarn, and evaluation of properties and performances of knitted and woven fabric in the PTT fiber.

The present inventors have found that it is effective to attain the objects of the present invention to adjust the elongation at break of the raw yarn of the PTT fiber within a specific range different from an optimum range of a polyethylene terephthalate fiber and a nylon fiber and to selectively specify frictional properties, thus completing the present invention.

That is, the present invention provides a polytrimethylene terephthalate fiber composed of a polytrimethylene terephthalate comprising not less than 95 mole % of a polytrimethylene terephthalate repeating unit and not more than 5 mole % of the other ester repeating unit and having an intrinsic viscosity of from 0.7 to 1.3, wherein the fiber satisfies the following features (1) to (6):

(1) a degree of crystalline orientation of from 88% to 95%, (2) a peak value of dynamic loss tangent (tan δ) max of from 0.10 to 0.15, (3) a peak temperature Tmax (°C.) of dynamic loss tangent from 102 to 116° C., (4) an elongation at break of from 36 to 50%, (5) a peak value of thermal stress being between 0.25 and 0.38 g/d, and (6) a fiber to fiber dynamic frictional coefficient of from 0.30 to 0.50.

The polytrimethylene terephthalate fiber of the present invention can be produced by a method of producing a polytrimethylene terephthalate fiber, which comprises extruding a polytrimethylene terephthalate comprising not less than 95 mole % of a polytrimethylene terephthalate repeating unit and not more than 5 mole % of the other ester repeating unit and having an intrinsic viscosity of from 0.7 to 1.3 at 250 to 275° C., solidifying an extrudate with a cooling air, coating the extrudate with a finishing agent, spinning the coated extrudate at a withdrawal speed of from 1000 to 2000 m/min, taking up an undrawn yarn once, and then drawing the undrawn yarn, wherein the method satisfies the following conditions (a) to (c):

(a) the undrawn yarn is coated with the finishing agent so that a fiber to fiber dynamic frictional coefficient of the fiber after drawing and heat-treatment is from 0.30 to 0.50, (b) the coated undrawn yarn is drawn at a draw tension from 0.35 to 0.7 g/d, and then (c) the drawn yarn is subjected to stretch heat-treatment at the temperature of from 100 to 150° C.

BRIEF DESCRIPTION OF THE INVENTION

Figure 1:
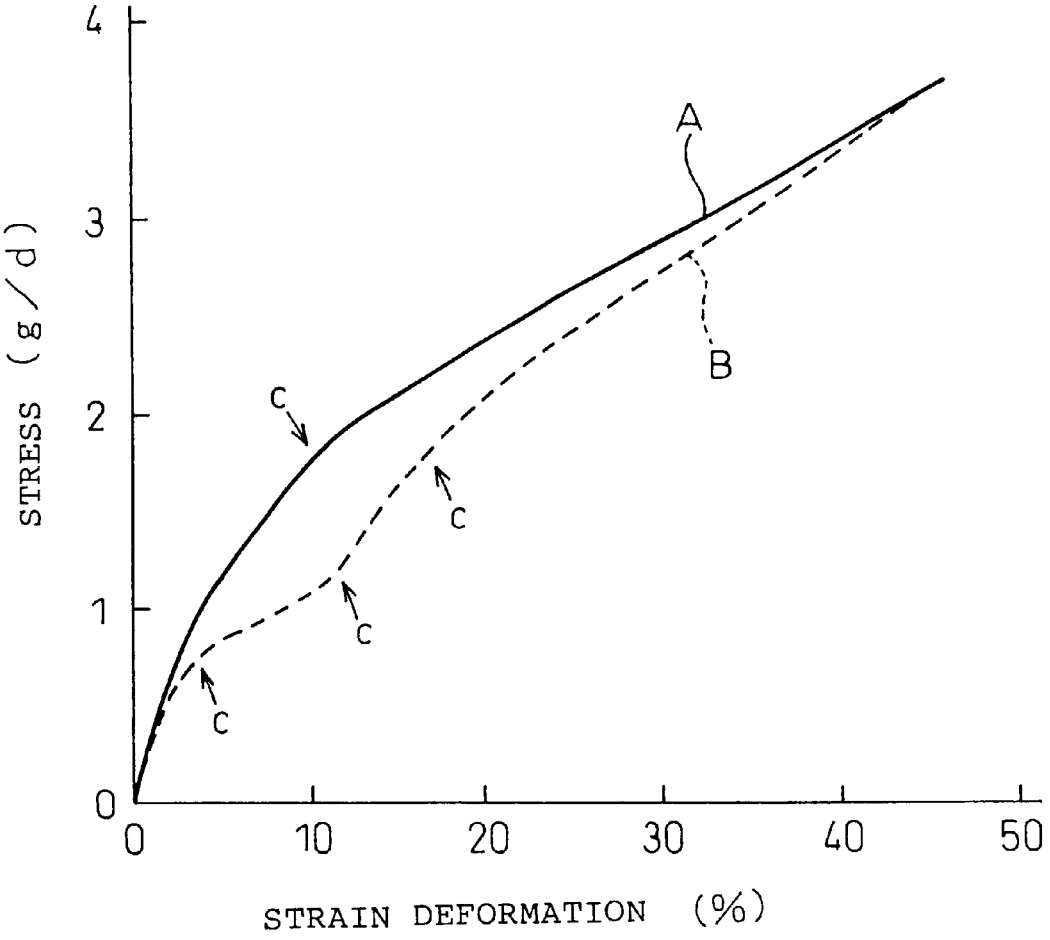
FIG. 1 is a graph showing a stress-strain curve of fibers.

The present invention will be described in detail below. In the present invention, not less than 95 mole % of the polymer constituting the polytrimethylene terephthalate fiber is occupied by a polytrimethylene terephthalate obtained by polycondensing terephthalic acid and 1,3-trimethylene glycol. As far as the object of the present invention is not impaired, that is, the proportion is within a range of not more than 5 mole %, the polymer may be copolymerized or blended with one or more of other copolymers and polymers. Examples of the comonomer and polymer include dicarboxylic acids such as oxalic acid, succinic acid, adipic acid, isophthalic acid, phthalic acid, 2,6-naphthalenedicarboxylic acid, and 5-sodiumsulfoisophthalic acid; glycols such as ethylene glycol, butanediol, and polyethylene glycol; and polymers such as polyethylene terephthalate and polybutylene terephthalate.

In the present invention, the intrinsic viscosity of the polytrimethylene terephthalate, which constitutes the fiber, must be from 0.7 to 1.3. When the intrinsic viscosity is less than 0.7, it is impossible to obtain the breaking strength of 3 g/d or more (when the elongation at break is 36% or more) which is suited for clothing, even if any spinning conditions are applied. On the other hand, a polytrimethylene terephthalate fiber having the intrinsic viscosity of more than 1.3 cannot be obtained. The reason is as follows. However the intrinsic viscosity of the raw polymer is enhanced, the intrinsic viscosity is drastically reduced by thermal decomposition during the melt-spinning and the intrinsic viscosity of the fiber is not more than 1.3. The intrinsic viscosity is preferably within a range from 0.85 to 1.1 because high breaking strength can be obtained.

In the present invention, the degree of crystalline orientation must be from 88 to 95%. This range of the degree of crystalline orientation is a condition required to attain the elongation at break of from 36 to 50%. To attain the elongation at break of 50% or less, the degree of crystalline orientation must be from 88 to 95%. The degree of crystalline orientation of 95% is a maximum value of the PTT fiber. The degree of crystalline orientation is preferably within a range from 90 to 94%.

The peak value of dynamic loss tangent must be from 0.10 to 0.15 and the peak temperature of dynamic loss tangent must be from 102 to 116° C., respectively. When the peak value and peak temperature of dynamic loss tangent are not within this range, the elongation at break is less than 36% or exceeds 50% and the peak value of thermal stress is less than 0.25 g/d or exceeds 0.38 g/d. The peak value of dynamic loss tangent is preferably within a range from 0.11 to 0.14 and the peak temperature of dynamic loss tangent is preferably within a range from 104 to 110° C., respectively.

In the present invention, the elongation at break must be from 36 to 50%. When the elongation at break is less than 36%, not only yarn breakage and fluff frequently occur during the production process of the fiber, particularly drawing process, industrial production is hardly performed, but also defects often occur during the post-processing process of the fiber. It is difficult to perform false twisting, thereby causing defects such as frequent yarn breakage and fluff. On the other hand, when the elongation at break exceeds 50%, ununiformity of the yarn in a longitudinal direction is enhanced, thereby to cause poor U % and drastic dye spot. The elongation at break is preferably within a range from 38 to 50%. In view of the knitting ability and false twisting ability, the elongation at break is most preferably within a range from 43 to 50%.

In the present invention, the peak value of thermal stress must be from 0.25 to 0.38 g/d. When the peak value of thermal stress is less than 0.25 g/d, the tightness of the knitted fabric due to heat shrinkage is poor when using the PTT fiber of the present invention in a spandex mixed weave, and drawbacks referred commonly as "grinning" are likely to occur. By the way, the term "grinning" refers to a phenomenon wherein deviation of the fiber occurs when a knitted fabric is repeatedly rubbed, resulting in space or gaps in the knitted fabric. When the peak value of stress under heat exceeds 0.38 g/d, a large shrinkage occurs during the heat-treatment process after forming into a texture, thus making it difficult to adjust the size as predetermined. The peak value of thermal stress is preferably within a range from 0.28 to 0.35 g/d. The peak value of thermal stress is more preferably within a range from 0.28 to 0.33 g/d.

In the present invention, the fiber to fiber dynamic frictional coefficient must be from 0.35 to 0.50. When the fiber to fiber dynamic frictional coefficient exceeds 0.50, it is impossible to avoid the occurrence of yarn breakage and fluff during the raw yarn producing process (i.e. drawing process) and raw yarn processing process (i.e. false twisting process and twisting process) even when designed to the elongation at break from 36 to 50%. The smaller the fiber to fiber dynamic frictional coefficient, the better. However, it is difficult to reduce the fiber to fiber dynamic frictional coefficient to 0.30 or less because of properties of the polytrimethylene terephthalate fiber. The fiber to fiber dynamic frictional coefficient is preferably within a range from 0.30 to 0.45.

In the present invention, the free shrinkage factor is preferably 2% or less. When the free shrinkage factor exceeds 2%, the texture design becomes complicated during the knitting/weaving. Actual problems caused in case the free shrinkage factor is large will be exemplified. In case the fiber is directly formed into a knitted and woven fabric from a thread-wound material such as cheese-shaped package or pirn, it is necessary to knit the length of 51.5 m to produce a knit of 50 m in length when the free shrinkage factor is 3%. Such an additional knitting is industrially useless and is hardly employed. The smaller the free shrinkage factor, the better. However, when the free shrinkage factor is not more than 1.5%, the textile design during the knitting/weaving can be satisfactorily carried out. Furthermore, high free shrinkage means the presence of a shrinking ability even under restriction. The PTT fiber having a free shrinkage factor of larger than 2% also has a drawback that shape retention is liable to be lost in a take-up package, particularly pirn shape, during or after taking up.

In the present invention, the number of inflection points in a stress-strain curve is preferably one or two. The stress-strain curve can be determined from a tensile test under a constant rate of extension as described below. When the number of inflection points in the stress-strain curve is three or more, the free shrinkage factor exceeds 2% and the textile design becomes complicated during the knitting/weaving. The number of inflection points is preferably two, and more preferably one.

The PTT fiber of the present invention is preferably taken up in the shape of a pirn at the number of twists from 5 to 25/m. Twisting remarkably contributes to an improvement in process performances in the knitting/weaving process or warping and false twisting processes prior to the knitting/weaving process, that is, speed up or reduction of frequency of troubles such as yarn breakage and fluff. When the number of twists is less than 5/m or 0/m, the state of bundling of a multifilament is poor and slack and yarn breakage are liable to occur during the production of the knitted and woven fabric. When the number of twists exceeds 25/m, an excess influence of twisting is exerted on the knitted or woven fabric, thereby lowering the quality. The number of twists is preferably within a range from 8 to 15/m.

In the production of the polytrimethylene terephthalate in the present invention, polymerization may be performed by a known polymerization method. The polytrimethylene terephthalate in the present invention may contain additives, for example, matting agents such as titanium oxide, thermal stabilizers such as phosphorous compound, oxidative stabilizers such as hindered phenol, antistatic agents, and ultraviolet screening agents.

Preferred method of producing the polytrimethylene terephthalate fiber of the present invention is a method, which comprises extruding a polytrimethylene terephthalate comprising not less than 95 mole % of a polytrimethylene terephthalate repeating unit and not more than 5 mole % of the other ester repeating unit and having an intrinsic viscosity of from 0.7 to 1.3 at 250 to 275° C., solidifying an extrudate with cooling air, coating the extrudate with a finishing agent, spinning the coated extrudate at a withdrawal speed of from 1000 to 2000 m/min, taking up an undrawn yarn once, and then drawing the undrawn yarn, wherein the method satisfies the following conditions (a) to (c):

(a) the undrawn yarn is coated with the finishing agent so that a fiber to fiber dynamic frictional coefficient of the fiber after drawing and heat-treatment is from 0.30 to 0.50, (b) the coated undrawn yarn is drawn at a draw tension from 0.35 to 0.7 g/d, and then (c) the drawn yarn is subjected to stretch heat-treatment at the temperature of from 100 to 150° C.

Figure 2:
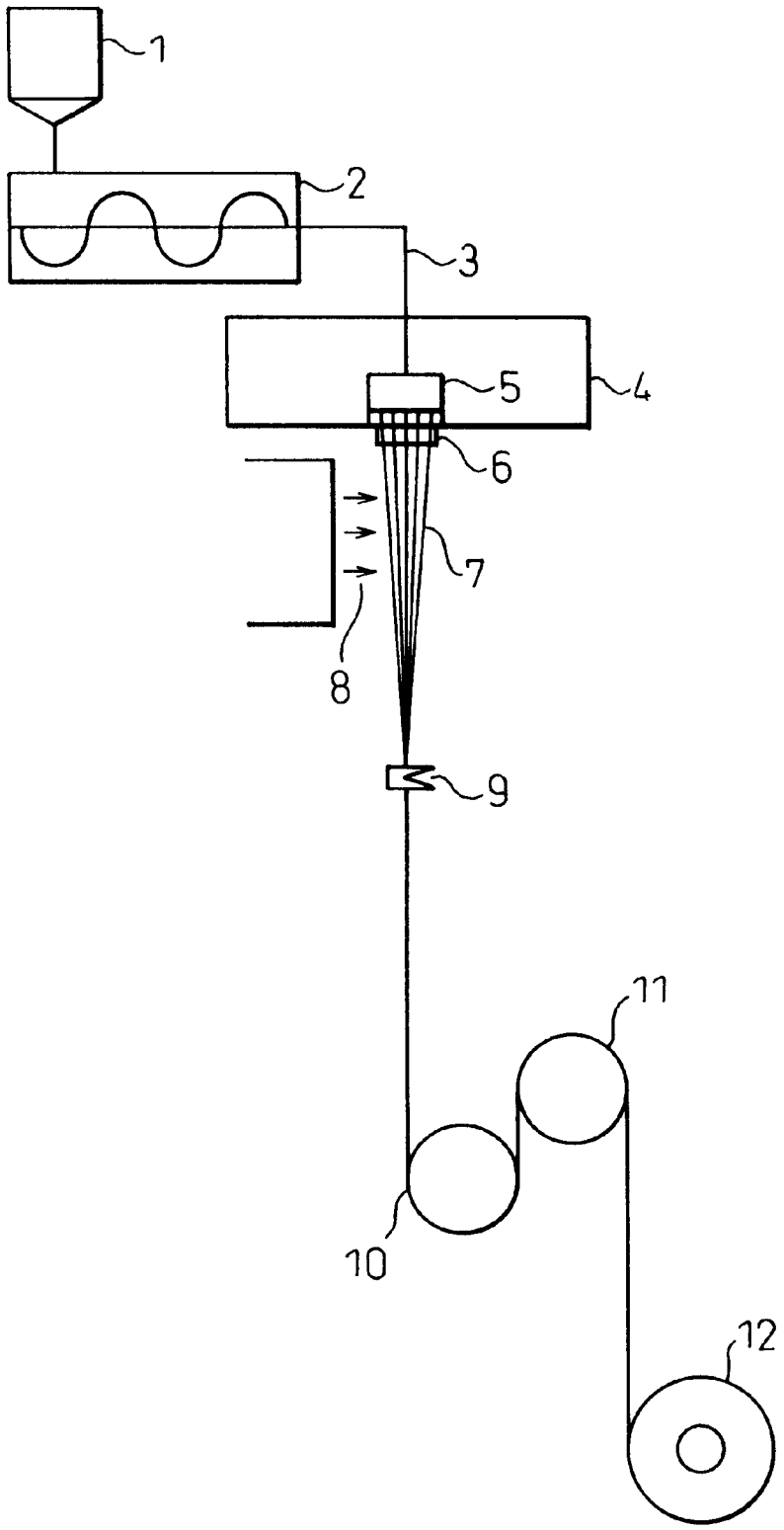
FIG. 2 is a schematic view showing an outline of a spinning machine for carrying out the present invention.

In case of producing the fiber, a undrawn yarn is produced by using a spinning machine shown in FIG. 2. The undrawn yarn is produced in the following manner. First, PTT pellets, dried in a drying machine 1 so that the water content is reduced to 30 ppm or less, are fed to an extruder 2 maintained at 255 to 265° C. and then molten. The molten PTT is delivered to a spin head 4 maintained at 260 to 275° C. and then weighed by a gear pump. The molten PTT is then extruded through a spinneret 6, which has a plurality of holes and is provided in a pack 5, into a multifilament 7 in a spinning chamber. The temperature of the extruder and that of the spin head are selected within the above range according to the intrinsic viscosity and shape of the PTT pellets.

The PTT multifilament extruded in the spinning chamber is made fine and is solidified by withdrawal godet rolls 10,11 rotating at a predetermined speed while being cooled to room temperature by cooling air 8, thus obtaining an undrawn yarn having a predetermined fineness. The undrawn yarn is coated with a finishing agent by a finishing agent coating device 9 before taking up around the withdrawal godet rolls, and then taken up by a take-up machine 12 as an undrawn yarn package 12.

The take-up speed of the undrawn yarn employed is from 1000 to 2000 m/minute. When the spinning speed is smaller than 1000 m/minute, a large amount of a crystallite is formed in the undrawn yarn and fluff and yarn breakage are liable to occur during the following drawing process. On the other hand, when the speed is not less than 2000 m/minute, shrinkage of fibers in the undrawn yarn is caused by formation of crystallite and relaxation of orientation of molecules, thus causing draw spot, fluff and yarn breakage during the drawing, which is not preferred.

The fiber to fiber dynamic frictional coefficient is adjusted within the range defined in the present invention by selecting the composition of the finishing agent. The composition is optionally selected from an oil agent containing 10 to 80% by weight of a fatty acid ester and/or mineral oil, or 50 to 98% by weight of a polyether having a molecular weight of from 1000 to 20000. The finishing agent may be any of water emulsion type, solvent diluted type and neat type finishing agents. In case of coating with an emulsion type finishing agent, the above component is mixed with 2 to 50% by weight of an ionic surfactant and/or a nonionic surfactant and a 10 to 30% by weight of an emulsion is preferably used. The finishing agent may be coated by a known method such as an oiling nozzle method or an oiling roll method.

Figure 3:
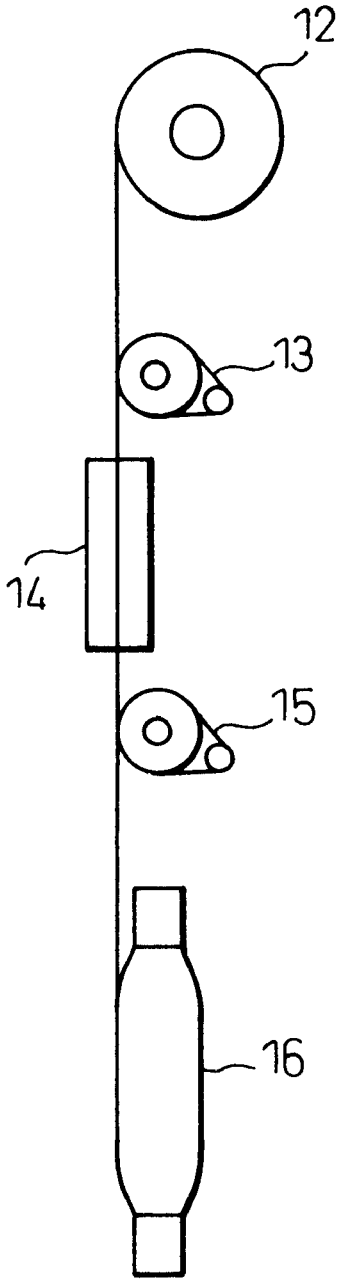
FIG. 3 is a schematic view showing an outline of a drawing-twisting type drawing machine (with no fixed drawing pin) for carrying out the present invention.

Then, the undrawn yarn package is tried on a drawing machine shown in FIG. 3. In the drawing machine, the undrawn yarn 12 is heated first on a feed roll 13 maintained at 45 to 65° C. and then drawn to a predetermined fineness by making use of a speed ratio of a draft roll 15 and the feed roll 13. In this case, a draw starting point exists on the feed roll 13. The fiber is fed between the feed roll and draft roll after or during the drawing, and then subjected to stretch heat-treatment by traveling while contacting with a hot plate 14 maintained at 100 to 150° C. The fiber from the draft roll 15 is taken up as a pirn 16 while being twisted by a spindle. In that case, a ratio, i.e. a draw ratio of the draft roll and feed roll as well as a hot plate temperature must be controlled so that the draw tension is from 0.35 to 0.7 g/d. When the draw tension is less than 0.35 g/d, the elongation at break of the fiber exceeds 50%. On the other hand, when the draw tension is not less than 0.7 g/d, the elongation at break of the fiber is less than 36%. The draw tension is preferably within a range from 0.35 to 0.65 g/d, and more preferably from 0.35 to 0.50 g/d.

The stretch heat-treatment temperature must be from 100 to 150° C. When the stretch heat-treatment temperature is less than 100° C., not only the degree of crystalline orientation is less than 88%, but also the peak value of thermal stress exceeds 0.38 g/d. On the other hand, when the stretch heat-treatment temperature exceeds 150° C., the peak value of thermal stress is less than 0.25 g/d. The hot plate temperature is preferably within a range from 110 to 145° C.

When the draw tension and stretch heat-treatment temperature are within the range of the present invention, the free shrinkage factor is reduced to 2% or less. In case the stretch heat-treatment temperature is low, strain of the draw tension is not fixed. Therefore, strain exists in the drawn pirn and the free shrinkage factor exceeds 2%

Figure 4:
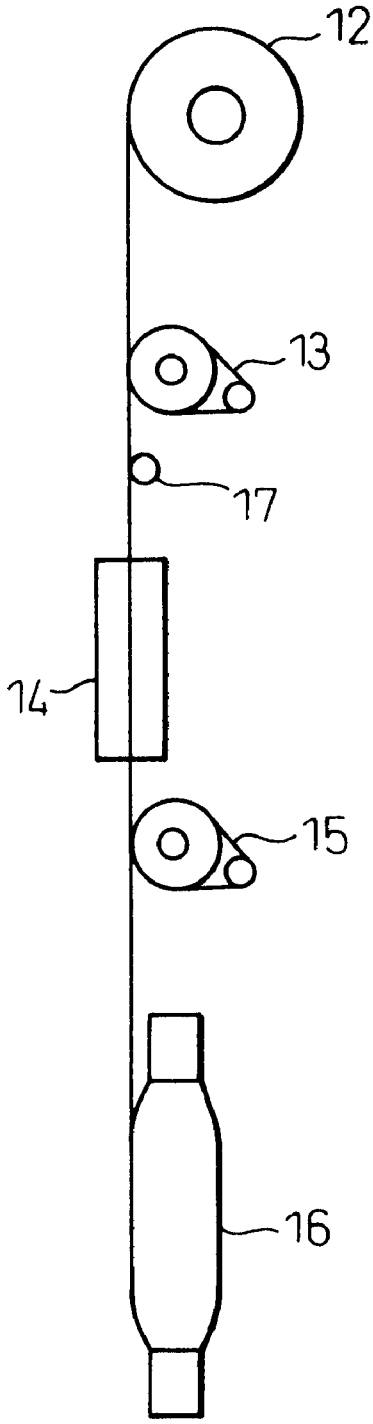
FIG. 4 is a schematic view showing an outline of a drawing-twisting type drawing machine (with a fixed drawing pin) for carrying out the present invention.

In case of the drawing, a fixed drawing pin 17 shown in FIG. 4 is preferably employed. By employing the fixed drawing pin, the draw starting point changes from the draft roll 13 to the position of the fixed drawing pin 17, thereby further improving the dyeing quality of the drawn yarn.

The method of producing the polytrimethyleneterephthalte fiber of the present invention must be carried out by the above-described two-stage process wherein the spinning process and the drawing process are separated. The drawing machine used in the production of the undrawn fiber of the present invention is preferably a drawing-twisting type drawing machine wherein the fiber is continuously taken up in the shape of a pirn after drawing as shown in FIG. 3 and FIG. 4.

BEST MODE FOR CARRYING OUT THE INVENTION

The procedure and conditions for measurement of physical properties or structure in the present invention (also including Examples) will be described below.

(a) Intrinsic Viscosity

The intrinsic viscosity [η] is a value determined based on the definition of the following equation.

$$[\eta]=\lim_{C\to 0}(\eta r-1)/C$$

ηr in the definition of the equation is a value determined by dividing a viscosity at 35° C. of a diluted solution, prepared by dissolving a polytrimethylene terephthalate polymer in o-chlorophenol with a purity of 98%, by a viscosity of the solvent itself as measured at the same temperature, and is defined as a relative viscosity. C is a weight value (g) of a solute in 100 ml of the above solution.

(b) Degree of Crystalline Orientation

Using a X-ray diffraction apparatus, a diffraction intensity curve of a sample having a thickness of about 0.5 mm was recorded at a diffraction angle 2θ ranging from 7 to 35 degree under the following conditions.

Measuring conditions are as follows: 30 kv, 80 A, scanning speed: 1 degree/minute, chart speed: 10 mm/minute, time constant: 1 second, and receiving slit: 0.3 mm.

Reflection recorded at 2θ of 16 degree and that recorded at 2θ of 22 degree are (010) and (110), respectively. Furthermore, a diffraction intensity curve of the (010) plane is drawn at an azimuth angle ranging from −180 degree to +180 degree.

An average value of the diffraction intensity curve obtained at ±180 degree is determined, and a horizontal line is drawn and taken as a base line. A perpendicular is dropped to the base line from a vertex, and a middle point of the height is determined. A horizontal line, which intersects the middle point, is drawn and the distance between two intersections of the horizontal line and the diffraction intensity curve is measured. The value obtained by calculating this value in terms of an angle is taken as an orientation angle H. The degree of crystalline orientation is given by the following equation.

$$\text{Degree of crystalline orientation } (\%) = (180 - H) \times 180/180$$

(c) Dynamic Loss Tangent

Using a Rheovibron DDV-EIIA type dynamic viscoelasticity measuring apparatus manufactured by Toyo Baldwin Co., the dynamic viscoelasticity of 0.1 mg of a sample was measured under the conditions of a measuring frequency of 110 Hz and a heating speed of 5° C./minute. A peak temperature Tmax of tan δ and a peak value (tan δ) max as a peak height are obtained from a dynamic loss tangent (tan δ)-temperature curve at each temperature in a dry air.

(d) Elongation at Break of Fiber

It was measured according to JIS-L-1013.

(e) Peak Value of Thermal Stress

Using a heat stress measuring apparatus (e.g. manufactured by Kanebo Engineering Co., Ltd. under the trade name of KE-2), the peak value of thermal stress is measured. After cutting the fiber into a length of 20 cm, a loop is made by tying both ends and it is then put in a measuring apparatus. Under the conditions of an initial load of 0.05 g/d and a heating speed of 100° C./minute, the thermal stress is measured and a change with the temperature is recorded on a chart. A peak value of the heat stress curve is read. The resulting value is a peak value of stress under heat.

(f) Fiber to Fiber Dynamic Frictional Coefficient

A fiber of 690 m is taken up around a cylinder at a twill angle of 15 degree while applying a tension of about 15 g, and then hung on a cylinder around which the same fiber of 30.5 cm is taken up. In this case, this fiber was hung in the direction vertical to the axis of the cylinder. A poise having a weight (g), that is 0.04 times a total denier of the fiber hung on the cylinder, was tied to one end, while a strain gauge was connected to the other end. Then, this cylinder was rotated at a circumferential speed of 18 m/minute and the tension was measured by the strain gauge. The fiber to fiber dynamic frictional coefficient f was determined from the tension thus measured.

$$f = 1/\pi \times ln(T2/T1)$$

T1 is a weight (g) of a poise hung on the fiber, T2 is an average tension (g) as measured at least 25 times, ln is a natural logarithm, and π is a ratio of the circumference of a circle to its diameter. The measurement was performed at 25° C.

(g) Free Shrinkage Factor

It was measured according to the shrinkage measuring method defined in JIS-L-1013. A hank was collected directly from a drawn yarn pirn by using a length inspecting machine and the free shrinkage factor was calculated from the following equation:

$$\text{Free shrinkage factor } (\%) = \frac{L - L1}{L} \times 100$$

where L is a length of a hank immediately after collection (within about five minutes) and L1 is a length of a hank which was allowed to stand in an atmosphere of a temperature of 20±2° C. and a relative humidity of 65%±5% for 48 hours.

(h) Draw Tension

Using a ROTHSCHILD Mini Tens R-046 as a tension meter, a tension T (g) applied to the fiber traveling the distance between a feed roll and a heat-treatment apparatus (in this example, the tension was measured between a feed roll 13 and a hot plate 14 in FIG. 3, and between a fixed drawing pin and a hot plate in FIG. 4) was measured and the draw tension was determined by dividing T by a denier D (d) of the fiber after drawing.

$$\text{Draw tension } (g/d) = T/D$$

(i) Drawing Ability

Yarn breakage defects during drawing were evaluated by the number of yarn breakage per 1000 kg of the drawn fiber. When the number of yarn breakage is not more than 10, industrially stable production can be performed. When the number of yarn breakage is from 11 to 20, almost stable production can be performed. When the number of yarn breakage exceeds 20, industrial production can hardly be performed.

(j) Knitting Ability

Polytrimethylene terephthalate fibers and spandex fibers were knitted into a 6 course satin texture with a raschel stitch. Using a knitting machine (28 gauge, 105 inch), knitting was performed at 91 course/inch at 600 rpm. As for the knitted texture, polytrimethylene terephthalate fibers were used for front and spandex fibers having 280 deniers were used for back. In case of both front and back, knitting was performed at a knitting tension of 10 g.

The state of the occurrence of fluff of the knitted fabric was visually judged. Those which are free from fluff were rated "○", while those which caused fluff were rated "X".

(k) Grinning

The ruschel warp knitted fabric was cut into a piece of 100 mm in a warp direction and 90 mm in a weft direction, which is then seamed at a margin for seam of 7 mm in a weft direction using a double needle overlock. At this time, a test piece was made at 13 needles per inch as the number of needle stitch per inch using a wooly nylon 210 d as a machine cotton. This test piece was sufficiently dipped in an aqueous 0.13% solution of a weak alkali synthetic detergent and tested on an expansion fatigue testing machine with a chuck distance of 70 mm so that the seam is positioned at the center. After repeating expansion 10000 times at a predetermined expansion amount (described below), the test piece was removed and evaluated by the following criteria.

◎: The test piece is almost the same as that before tried on an expansion fatigue testing machine.

○: The test pieces slightly extended in a width direction and the appearance slightly became inferior.

X: The test pieces extended in a width direction and the appearance considerably became inferior (e.g. degradation of texture, yarn breakage of elastic yarn, etc.) so that it is not suited for use as a product.

In case of testing on the expansion fatigue testing machine, the extension of the test pieces was determined in the following manner.

The raschel warp knitted fabric is cut into a piece of 200 mm in length and 25.4 mm in width, which is then stretched by a Tensilon tensile test machine under the conditions of an initial load (of a test piece) of 5 g, a chuck distance of 100 mm and a stretching speed of 300 mm/minute. Then, an extensibility on loading of 1 kg and an extensibility on loading of 1.5 kg are determined and the extension is calculated from the following equation. Extension ( %)= [(extensibility on loading of 1 kg)+(extensibility on loading of 1.5 kg)]/2

(1) False Twisting Ability

False twisting was performed under the following conditions and the false twist processing ability was evaluated by the number of yarn breakages per day in case of continuously carrying out false twisting at 72 spindle/machine.

False Twisting Conditions

False twisting machine: LS-2 (pin false twisting) manufactured by Mitsubishi Heavy Industries Co., Ltd.

Spindle rotating speed: 275000 rpm

Number of false twists: 3840 T/m

First feed ratio: ±0%

First heater temperature (contact type): 160° C.

Second heater temperature (non-contact type): 150° C.

Second feed ratio: ±15%

False Twisting Ability

◎: The number of yarn breakage is less than 10/day.machine and is very good.

○: The number of yarn breakage is from 10 to 30/day.machine and is good.

X: The number of yarn breakage exceeds 30/day.machine and industrial production is hard to performed.

Reference Example

<Polymerization of Polytrimethylene Terephthalate>

Dimethyl terephthalate and 1,3-propanediol were charged in a molar ratio of 1:2 and titanium tetrabutoxide was added in the amount corresponding to 0.1% by weight of a theoretical polymer amount and, after gradually raising the temperature, the ester exchange reaction was completed at 240° C. To the resulting ester exchange product, titanium tetrabutoxide was further added in the amount corresponding to 0.1% by weight of a theoretical polymer amount and 0.5% by weight of titanium oxide as a matting agent was added, and then the mixture was reacted under reduced pressure at 250° C. for three hours. The intrinsic viscosity of the resulting polymer was 0.7.

The solid phase polymerization of the polymer was performed under a nitrogen gas flow at 200° C. over five hours to obtain a polymer having the intrinsic viscosity of 0.9.

EXAMPLES 1 to 4 and

Comparative Examples 1 to 4

In these Examples, the effect of the draw stress will be described. The polytrimethylene terephthalate obtained in the Reference Example was dried at 110° C. and then dried so that the water content is reduced to 20 ppm.

The resulting polymer was charged in an extruder 2 shown in FIG. 2, molten at the extrusion temperature of 270° C., and then spun through a spinneret 5 provided in a spin head 4. A group of spun filaments 7 was solidified with cooling by blowing cooling air 8 at 20° C. and 90% RH at a rate of 0.4 m/second. After coating the solidified fiber with a finishing agent using a finishing agent coating device (oiling nozzle) 9, an undrawn yarn was taken up after passing through a withdrawal roll rotating at a circumferential speed of 1500 m/minute.

An aqueous emulsion containing 10% by weight of a finishing agent comprising 52 parts of isooctyl stearate as a smoothing agent, 10 parts of liquid paraffin, 27 parts of oleyl ether made of polyoxyethylene as a surfactant, and 11 parts of $C_{15-16}$ alkane sulfonate sodium salt was used as the oil agent component. The fiber was coated with the finishing agent so that the coating ratio of the following drawn yarn is 0.8%. The fiber to fiber dynamic frictional coefficient of the drawn yarn was 0.405.

Using a drawing-twisting type drawing machine (with no fixed drawing pin) shown in FIG. 3, the undrawn yarn was drawn under the conditions of the roll temperature of 55° C., the hot plate temperature of 130° C. and the draw ratio adjusted so that the draw tension becomes a value shown in Table 1. In all Examples, denier of the drawn yarn was adjusted to 50 d/24 f and the number of twists was adjusted to 10/m. Properties of the resulting polytrimethylene terephthalate fiber of 50 d/24 f are shown in Table 1.

As is apparent from Table 1, the polytrimethylene terephthalate fiber obtained by drawing at the draw tension within the range shown in the present invention had the following production properties, that is, the fiber exhibited good drawing ability and knitting ability and was free from grinning defects.

TABLE 1

| | Draw tension g/d | Degree of crystalline orientation % | Peak value of dynamic loss tangent [(tan δ)max] | Peak temperature Tmax of dynamic loss tangent (° C.) | Elongation at break % | Peak value of thermal stress g/d | Drawing ability Number/t | Knitting ability | Grinning | False twisting ability | General evaluation |
|---|---|---|---|---|---|---|---|---|---|---|---|
| Comp. Example 1 | 0.9 | 95 | 0.10 | 108 | 27 | 0.49 | 23 | x | ○ | x | x |
| Comp. Example 2 | 0.8 | 95 | 0.11 | 108 | 34 | 0.40 | 12 | x | ○ | x | x |
| Example 1 | 0.7 | 94 | 0.11 | 108 | 36 | 0.38 | 9 | ○ | ◎ | ○ | ○ |
| Example 2 | 0.6 | 92 | 0.12 | 107 | 41 | 0.34 | 8 | ○ | ◎ | ○ | ○ |
| Example 3 | 0.5 | 92 | 0.12 | 105 | 44 | 0.32 | 8 | ○ | ◎ | ◎ | ◎ |
| Example 4 | 0.4 | 91 | 0.12 | 104 | 50 | 0.25 | 7 | ○ | ◎ | ◎ | ◎ |
| Comp. Example 3 | 0.3 | 90 | 0.11 | 103 | 53 | 0.18 | 6 | ○ | x | ○ | x |
| Comp. Example 4 | 0.2 | 89 | 0.11 | 103 | 60 | 0.14 | 6 | ○ | x | ○ | x |

EXAMPLES 5 to 8 and

Comparative Examples 5 to 6

In these Examples, the effect of the hot plate temperature will be described. In the same manner as in Examples 1 to 4, an undrawn yarn was obtained. Using a drawing-twisting type drawing machine (with a fixed drawing pin) shown in FIG. 4, the undrawn yarn was drawn under the conditions of the draw ratio of 2.35 and different hot plate temperatures as shown in Table 2. Properties of the resulting polytrimethylene terephthalate fiber of 50 d/24 f are-shown in Table 2.

As is apparent from Table 2, the polytrimethylene terephthalate fiber obtained by drawing at the hot plate temperature within the range shown in the present invention had the following production properties, that is, the fiber exhibited good drawing ability and knitting ability and was free from grinning defects.

stress under heat was 0.34 g/d. Properties of the resulting polytrimethylene terephthalate fiber of 50 d/24 f are shown in Table 3.

As is apparent from Table 3, the polytrimethylene terephthalate fiber whose fiber to fiber dynamic frictional coefficient is within the range of the present invention had the following production properties, that is, the fiber exhibited good drawing ability and knitting ability and was free from grinning defects.

Comparative Example 9

A comparison in free shrinkage factor between the present invention where spinning and drawing are performed in two stages and-the case where spinning and drawing are performed in one stage was made.

The free shrinkage factor of the undrawn yarn package of Example 5. of WO-99/27168 was measured. As a result, it was 2.6%.

TABLE 2

| | Hot plate temperature ° C. | Degree of crystalline orientation % | Peak value of dynamic loss tangent [(tan δ)max] | Peak temperature Tmax of dynamic loss tangent (° C.) | Elongation at break % | Peak value of thermal stress g/d | Free shrinkage factor % | Drawing ability Number/t | Knitting ability | Grin-ning | General evaluation |
|---|---|---|---|---|---|---|---|---|---|---|---|
| Comp. Example 5 | 30 | 88 | 0.11 | 102 | 43 | 0.44 | 2.4 | 40 | x | ○ | x |
| Comp. Example 6 | 80 | 89 | 0.11 | 103 | 43 | 0.40 | 2.1 | 17 | x | ○ | x |
| Example 5 | 100 | 89 | 0.12 | 104 | 42 | 0.38 | 1.6 | 10 | ○ | ⊙ | ○ |
| Example 6 | 120 | 91 | 0.12 | 107 | 42 | 0.34 | 1.4 | 6 | ○ | ⊙ | ○ |
| Example 7 | 140 | 92 | 0.12 | 108 | 42 | 0.32 | 1.2 | 9 | ○ | ⊙ | ○ |
| Example 8 | 150 | 93 | 0.11 | 110 | 42 | 0.28 | 1.1 | 10 | ○ | ○ | ○ |

EXAMPLES 8 to 11 and

Comparative Examples 7 to 8

In these Examples, the effect of the fiber to fiber dynamic frictional coefficient will be described. In case of obtaining the fiber of Example 2, the kind and amount of the oil agent was varied as shown in Table 3.

In these Examples, the degree of crystalline orientation of the polytrimethylene terephthalate fiber was 92%, the peak value of dynamic loss tangent (tan δ) max was 0.12, the peak temperature Tmax (°C.) of dynamic loss tangent was 107° C., the elongation at break was 42%, and the peak value of The stress-strain curve-of this fiber had three inflection points, as shown in the curve B in FIG. 1.

On the other hand, the free shrinkage factor of the drawn yarn pirn of Example 1 of the present invention was 1.4%. The stress-strain curve of this fiber had one inflection point, as shown in the curve A in FIG. 1.

In case where spinning and drawing are performed in one stage, the free shrinkage factor was larger than that in the case where spinning and drawing are performed in two stages.

TABLE 3

| | Finishing agent component A % | Finishing agent component B % | Finishing agent component C % | Finishing agent component D % | Coating ratio % | Fiber to fiber dynamic frictional coefficient | Drawing ability Number/t | Knitting ability | Grin-ning | General evaluation |
|---|---|---|---|---|---|---|---|---|---|---|
| Comp. Example 7 | 62 | 11 | 17 | 10 | 0.5 | 0.52 | 25 | x | ○ | x |
| Example 8 | 62 | 11 | 17 | 10 | 0.8 | 0.49 | 9 | ○ | ⊙ | ○ |
| Example 9 | 62 | 11 | 17 | 10 | 0.8 | 0.40 | 6 | ○ | ⊙ | ○ |
| Example 10 | 75 | 5 | 10 | 10 | 0.6 | 0.49 | 8 | ○ | ⊙ | ○ |
| Example 11 | 75 | 5 | 10 | 10 | 0.8 | 0.41 | 5 | ○ | ⊙ | ○ |
| Comp. Example 8 | 75 | 5 | 10 | 10 | 0.5 | 0.53 | 22 | x | ○ | x |

Finishing agent component A: polyether having a molecular weight of 2000 composed of propylene oxide and ethylene oxide (50:50) wherein both terminals are hindered with a butyl group and a methyl group
Finishing agent component B: alkanesulfonate sodium salt having 15 to 16 carbon atoms
Finishing agent component C: oleyl ether composed of 10 units of polyoxyethylenes
Finishing agent component D: polyalkylene ether having a molecular weight of 10000 composed of propylene oxide and ethylene oxide (40:60)

Industrial Applicability

The PTT fiber of the present invention is a high quality fiber wherein the occurrence of yarn breakage and fluff is prevented in the raw yarn producing process and the production yield is very high, because the physical properties and the surface properties are properly designed.

The PTT fiber of the present invention is less likely to cause defects such as yarn breakage and fluff during the processing process, that is, false twisting process, twisting process and knitting/weaving process, so that wide processing conditions can be employed. A texture having good product properties can be obtained by using the PTT fiber of the present invention.

What is claimed is:

1. A polytrimethylene terephthalate fiber composed of a polytrimethylene terephthalate comprising not less than 95 mole % of a polytrimethylene terephthalate repeating unit and not more than 5 mole % of the other ester repeating unit and having an intrinsic viscosity of from 0.7 to 1.3, wherein the fiber satisfies the following features (1) to (6):

(1) a degree of crystalline orientation of from 88% to 95%, (2) a peak value of dynamic loss tangent (tan δ) max of from 0.10 to 0.15, (3) a peak temperature Tmax (°C.) of dynamic loss tangent from 102 to 116° C., (4) an elongation at break of from 36 to 50%, (5) a peak value of thermal stress being between 0.25 and 0.38 g/d, and (6) a fiber to fiber dynamic frictional coefficient of from 0.30 to 0.50.

2. The polytrimethylene terephthalate fiber according to claim 1, wherein the elongation at break is from 43 to 50%.

3. The polytrimethylene terephthalate fiber according to claim 1, which is taken up in the shape of a pirn at the number of twists from 5 to 20/m.

4. A method of producing a polytrimethylene terephthalate fiber, which comprises extruding a polytrimethylene terephthalate comprising not less than 95 mole % of a polytrimethylene terephthalate repeating unit and not more than 5 mole % of the other ester repeating unit and having an intrinsic viscosity of from 0.7 to 1.3 at 250 to 275° C., solidifying an extrudate with a cooling air, coating the extrudate with a finishing agent, spinning the coated extrudate at a withdrawal speed of from 1000 to 2000 m/min, taking up an undrawn yarn once, and then drawing the undrawn yarn, wherein the method satisfies the following conditions (a) to (c):

(a) the undrawn yarn is coated with the finishing agent so that a fiber to fiber dynamic frictional coefficient of the fiber after drawing and heat-treatment is from 0.30 to 0.50, (b) the coated undrawn yarn is drawn at a draw tension from 0.35 to 0.7 g/d, and then (c) the drawn yarn is subjected to stretch heat-treatment at the temperature of from 100 to 150° C.

5. The method of producing a polytrimethylene terephthalate fiber according to claim 4, wherein the draw tension is from 0.35 to 0.5 g/d.

6. The method of producing a polytrimethylene terephthalate fiber according to claim 4, wherein the drawn yarn is taken up in the shape of a pirn at the number of twists from 5 to 25/m.

7. The polytrimethylene terephthalate fiber of claim 1 wherein the fiber satisfies the following feature:

(7) a free shrinkage factor of not more than 2%.

8. The polytrimethylene terephthalate fiber of claim 1 or 7, wherein the fiber satisfies the following feature:

(8) one or two inflection points in a stress-strain curve.

9. The method of producing a polytrimethylene terephthalate fiber according to claim 4, wherein after (c) the method satisfies the following condition:

(d) the heat-treated drawn yarn is twisted and taken up.

10. The method of producing a polytrimethylene terephthalate fiber according to claim 9, wherein after (a) and before (b) the method satisfies the following condition:

(a1) a fixed drawing pin is used.

* * * * *